US012584196B2

(12) United States Patent
Yoo

(10) Patent No.: US 12,584,196 B2
(45) Date of Patent: Mar. 24, 2026

(54) HIGHLY CORROSION-RESISTANT ALUMINUM ALLOY

(71) Applicant: WHEEL CORPORATION, Asan-si (KR)

(72) Inventor: Tae Seung Yoo, Seoul (KR)

(73) Assignee: WHEEL CORPORATION, Asan-si (KR)

( * ) Notice: Subject to any disclaimer, the term of this patent is extended or adjusted under 35 U.S.C. 154(b) by 489 days.

(21) Appl. No.: 17/924,562

(22) PCT Filed: Mar. 31, 2021

(86) PCT No.: PCT/KR2021/003980
§ 371 (c)(1),
(2) Date: Nov. 10, 2022

(87) PCT Pub. No.: WO2022/211148
PCT Pub. Date: Oct. 6, 2022

(65) Prior Publication Data

US 2023/0227948 A1 Jul. 20, 2023

(51) Int. Cl.
*C22C 21/00* (2006.01)
*C22C 21/14* (2006.01)

(52) U.S. Cl.
CPC ..... *C22C 21/14* (2013.01); *C22C 21/00* (2013.01)

(58) Field of Classification Search
CPC ..... C22C 21/00; C22C 21/02; C22C 21/14; C22C 21/16; C22F 1/043; C22F 1/04
See application file for complete search history.

(56) References Cited

U.S. PATENT DOCUMENTS

2002/0071782 A1 6/2002 Hasegawa et al.
2011/0076184 A1 3/2011 Zhang et al.

FOREIGN PATENT DOCUMENTS

| | | | | |
|---|---|---|---|---|
| CN | 108531783 B | | 4/2020 | |
| EP | 0293176 A2 | * | 11/1988 | ..... C22C 21/00 |
| GB | 1292508 A | * | 10/1972 | ..... C22C 21/00 |
| JP | 11-241136 A | | 9/1999 | |
| JP | 04411803 B2 | | 11/2009 | |
| JP | 4837188 B2 | | 12/2011 | |

(Continued)

OTHER PUBLICATIONS

English Abstract and English Machine Translation of KR-10-2010-0106930 (Nov. 4, 2010).*

(Continued)

*Primary Examiner* — Jessee R Roe
(74) *Attorney, Agent, or Firm* — Sughrue Mion, PLLC

(57) ABSTRACT

Proposed is a highly corrosion-resistant aluminum alloy including one or more components selected from among 0.1 wt. % or less (except for 0 wt. %) of Cu, 0.15 wt. % or less (except for 0 wt. %) of Si, 0.2 wt. % or less (except for 0 wt. %) of Fe, 0.9 to 1.5 wt. % of Mn, 0.03 to 0.15 wt. % of Ti, 0.03 to 0.15 wt. % of Cr, and 0.03 to 0.15 wt. % of Zr, and the remaining proportion of aluminum (Al) and unavoidable impurities. The highly corrosion-resistant aluminum alloy contains Ti, Cr, and Zr in a predetermined weight ratio or in equal weight percentages (wt. %), thereby exhibiting improved corrosion resistance in a saline water environment while exhibiting excellent levels in tensile strength and yield strength.

4 Claims, 2 Drawing Sheets

(56) References Cited

FOREIGN PATENT DOCUMENTS

| | | | |
|---|---|---|---|
| JP | 4846124 | B2 | 12/2011 |
| JP | 2012-112000 | A | 6/2012 |
| JP | 5710946 | B2 | 4/2015 |
| KR | 10-2005-0035447 | A | 4/2005 |
| KR | 10-2010-0106930 | A | 10/2010 |
| KR | 10-2015-0126625 | A | 11/2015 |
| KR | 10-1594729 | B1 | 2/2016 |
| KR | 10-2021-0099255 | A | 8/2021 |

OTHER PUBLICATIONS

International Search Report for PCT/KR2021/003980 dated Dec. 3, 2021.
Written Opinion for PCT/KR2021/003980 dated Dec. 3, 2021.
Office Action issued Dec. 5, 2023 in Japanese Application No. 2022-569161.
Extended European Search Report dated Apr. 23, 2024 in Application No. 21935264.8.

* cited by examiner

HIGHLY CORROSION-RESISTANT ALUMINUM ALLOY

This Application is a National Stage of International Application No. PCT/KR2021/003980 filed Mar. 31, 2021.

TECHNICAL FIELD

The technical idea of the present invention is directed to highly corrosion-resistant aluminum alloys and, more particularly, to aluminum alloys that have improved corrosion resistance in saline environments at increased tensile and yield strength levels.

BACKGROUND ART

In connection with aluminum alloys commonly used for vehicles, since pure aluminum is weak in strength, various elements, such as Mn, Si, Mg, Cu, Zn, Cr, etc. are added for strength improvement by precipitation hardening. Aluminum is highly corrosion-resistant in an environment having a pH of 4.5 to 8.5 because an aluminum base is protected by an oxide film. However, when aluminum comes into contact with Fe, Cu, Pb, etc. under a corrosive environment, the aluminum becomes highly corroded due to its high tendency to ionize. In the case of contact with mercury, aluminum is highly corroded even at a concentration of several ppms.

3xxx-series aluminum alloys are alloys with Mn as the main additive component and are non-thermal alloy having various properties according to cooling processing. Compared to pure aluminum, these aluminum alloys have slightly improved strength and are relatively good in weldability, corrosion resistance, and molding processability. In particular, Alloy 3003 is an alloy representing this series. This alloy has slightly increased strength and comparable processability and corrosion resistance compared to pure aluminum due to the addition of Mn. Such alloys have wide applications, including articles made of aluminum, construction materials, containers, and the like. Alloy 3004 and Alloy 3014 are alloys prepared by addition of 1 wt. % of Mg to Alloy 3003 have more improved strength compared to pure aluminum. However, these alloys cannot meet the molding processability and strength required for higher quality parts and are problematic in terms of being corroded in saline environments.

Therefore, there is a need for an aluminum alloy composition having improved corrosion resistance in a saline environment while having excellent tensile and yield strength applicable to a pipe structure used as a refrigerant line of a vehicle receiver dryer or a vehicle refrigerant delivery system, a coolant line, and a transmission oil cooler line.

PATENT LITERATURE (Patent Literature 1) Japanese Patent No. 04411803
(Patent Literature 2) Korean Patent Application Publication No. 10-2005-0035447

DISCLOSURE

Technical Problem

It is an objective of the present invention to provide an aluminum alloy to which Ti, Cr, and Zr are additionally added or in which Ti, Cr, and Zr are contained in equal weight percentages (wt. %) so that the aluminum alloy not only has good tensile strength and good yield strength but also has improved corrosion resistance in a saline water environment.

Technical Solution

In order to accomplish the objective, a highly corrosion-resistant aluminum alloy according to the technical idea of the present invention may include: one or more components selected from among 0.1 wt. % or less (except for 0 wt. %) of Cu, 0.15 wt. % or less (except for 0 wt. %) of Si, 0.2 wt. % or less (except for 0 wt. %) of Fe, 0.9 to 1.5 wt. % of Mn, 0.03 to 0.15 wt. % of Ti, 0.03 to 0.15 wt. % of Cr, and 0.03 to 0.15 wt. % of Zr; and the remaining proportion of aluminum (Al) and unavoidable impurities.

In some embodiments of the present invention, the 0.03 to 0.15 wt. % of Ti, 0.03 to 0.15 wt. % of Cr, and 0.03 to 0.15 wt. % of Zr may all be contained.

In some embodiments of the present invention, the 0.03 to 0.15 wt. % of Ti, 0.03 to 0.15 wt. % of Cr, and 0.03 to 0.15 wt. % of Zr may all be contained, in which the Ti, Cr, and Zr may be present in weight equal percentages (wt. %).

In some embodiments of the present invention, the 0.05 to 0.1 wt. % of Ti, 0.05 0.1 wt. % of Cr, and 0.05 to 0.1 wt. % of Zr may all be contained.

In some embodiments of the present invention, 0.05 to 0.1 wt. % of Ti, 0.05 to 0.1 wt. % of Cr, and 0.05 to 0.1 wt. % of Zr may all be contained, in which the Ti, Cr, and Zr may be present in equal weight percentages (wt. %).

Advantageous Effects

The highly corrosion-resistant aluminum alloy according to the technical idea of the present invention contains Ti, Cr, and Zr in a predetermined weight ratio or in equal weight percentages (wt. %), thereby not only having good tensile strength and good yield strength but also having improved corrosion resistance in a saline water environment.

The above-described effects of the present invention have been illustratively described, and the scope of the present invention is not limited by these effects.

BEST MODE

Figure 1:
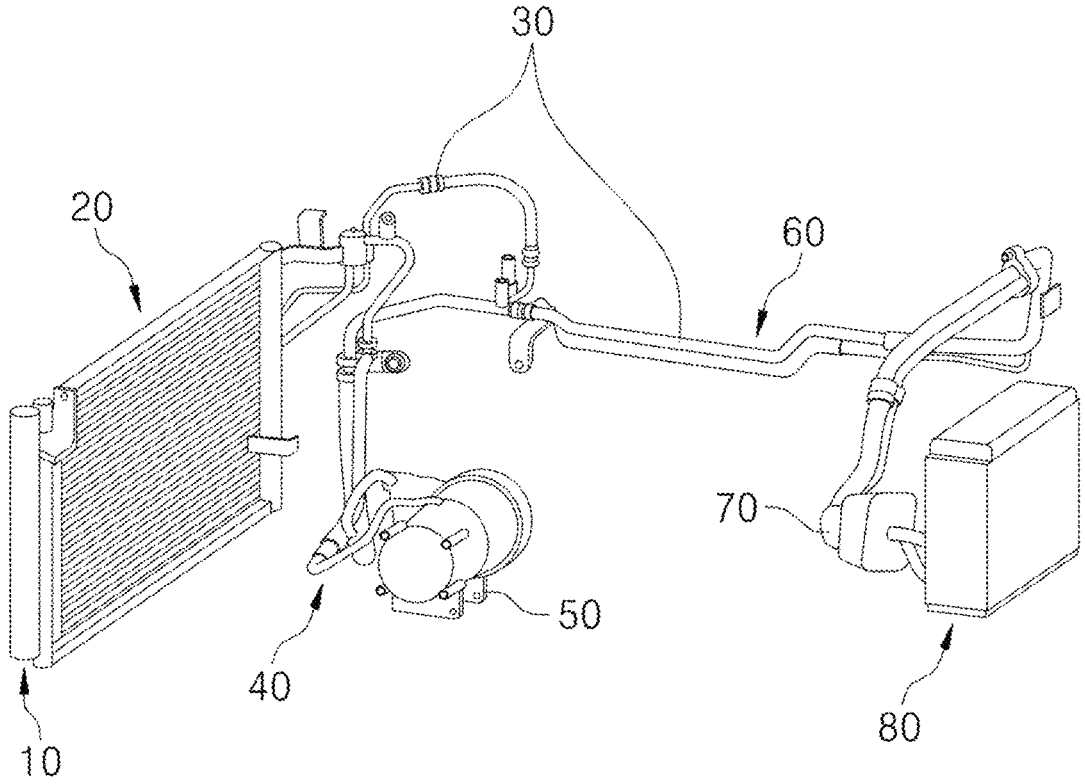
FIG. 1 is a schematic diagram of an automotive air conditioning and engine cooling system.

Hereinafter, preferred examples of the present invention will be described in detail with reference to the accompanying drawings. Examples of the present invention are presented to make complete the disclosure of the present invention and help those who are ordinarily skilled in the art best understand the invention. The examples described below may, however, be embodied in many different forms, and the scope of the technical idea of the present invention should not be construed as being limited to the examples. Rather, these examples are provided so that this disclosure will be thorough and complete, and will fully convey the concept of the invention to those skilled in the art. In addition, as used herein, the term "and/or" includes any one and any combination of one or more of the listed items. The same reference numerals refer to the same elements. Furthermore, various elements and regions in the drawings are schematically illustrated. Accordingly, the technical idea of the present invention is not limited by the relative sizes or spacings illustrated in the accompanying drawings.

An alloy according to the present disclosure may be used as a material of a receiver dryer 10 and a coolant expansion valve 70 used in an automotive air-conditioning and engine-cooling system and a material of pipes 30 and hoses 40 and 60 that connects the receiver dryer 10 and the expansion valve 70. In an automotive air conditioner, a condenser 20 operates to deprive gases or vapors of heat so that the gases or vapors liquefy when being sufficiently deprived of heat. The condenser 20 is a kind of radiator that discharges the heat of a gaseous refrigerant supplied from a compressor 50 to the atmosphere so that the gaseous refrigerant may become a liquid refrigerant. The more heat emitted, the better. The hot high-pressure refrigerant supplied from the compressor 50 is cooled and liquefied by a relatively cold external air and is then sent to the long cylindrical receiver dryer 10 made of aluminum. The receiver dryer 10 serves as a tank for storing the refrigerant and removes moisture contained in the refrigerant. When a vehicle is used for a long period of time, the vehicle suffers internal corrosion caused by a condensate that is internally generated. The vehicle also may suffer severe external corrosion caused by snow removal agents such as calcium chloride which is present on the road surface in winter. The alloy of the present invention is required to have high corrosion resistance.

A highly corrosion-resistant aluminum alloy according to the present invention may include: one or more components selected from among 0.1 wt. % or less (except for 0 wt. %) of Cu, 0.15 wt. % or less (except for 0 wt. %) of Si, 0.2 wt. % or less (except for 0 wt. %) of Fe, 0.9 to 1.5 wt. % of Mn, 0.03 to 0.15 wt. % of Ti, 0.03 to 0.15 wt. % of Cr, and 0.03 to 0.15 wt. % of Zr; and the remaining proportion of aluminum (Al) and unavoidable impurities.

Cu exhibits a curing effect in alloy and improves strength and ductility of the alloy. Preferably, Cu is controlled to be present in an amount in a range of higher than 0 wt. % to 0.1 wt. % (0 wt. %<Cu≤0.1 wt. %). More preferably, Cu is present in an amount in a range of higher than 0 wt. % to 0.05 wt. % (0 wt. %<Cu≤0.05 wt. %). When the content of Cu exceeds 0.1 wt. %, corrosion resistance is deteriorated. Therefore, Cu is present preferably in an amount of 0.1 wt. % or less and more preferably in an amount of 0.05 wt. % or less.

Si improves strength without deteriorating corrosion resistance in the alloy. Si precipitates and improves mechanical properties. Preferably, Si is controlled to be present in an amount in a range of higher than 0 wt. % to 0.15 wt. % (0 wt. %<Si≤0.15 wt. %). More preferably, Si is controlled to be present in an amount in a range of higher than 0 wt. % to 0.05 wt. % (0 wt. %<Si≤0.05 wt. %). When the content of Si exceeds 0.15 wt. %, not only is the moldability deteriorated, but the surface quality of a molded product therefrom may deteriorate. Therefore, Si is preferably added in an amount of 0.05 wt. % or less.

In the alloy, Fe contributes to strength enhancement by increasing the density of the alloy. Preferably, Fe is controlled to be present in an amount in a range of higher than 0 wt. % to 0.2 wt. % (0 wt. %<Fe≤0.2 wt. %). More preferably, Fe is controlled to be present in an amount in a range of higher than 0.05 wt. % to 0.15 wt. % (0.05 wt. %≤Fe≤0.15 wt. %). When the content of Fe exceeds 0.2 wt. %, ductility may be deteriorated, and extrudability and productivity may be reduced. In addition, corrosion may occur. Therefore, the upper limit of the content of Fe is preferably 0.2 wt. % or less and more preferably 0.15 wt. % or less.

Mn plays a role in increasing the softening resistance at high temperatures and improving surface treatment properties without deteriorating the corrosion resistance of the alloy. Mn also improves the strength properties using a solid solution strengthening effect and a fine precipitate dispersing effect. Preferably, Mn is controlled to be present in an amount in a range of 0.9 wt. % to 1.5 wt. % (0.9 wt. %≤Mn≤1.5 wt. %). More preferably, Mn is controlled to be present in an amount in a range of 1.0 wt. % to 1.5 wt. % (1.0 wt. %≤Mn≤1.5 wt. %). When the content of Mn is lower than 0.9 wt. %, the effect of Mn addition is insignificant. On the other hand, when the content of Mn exceeds 1.5 wt. %, castability is poor.

Ti improves formability and strength through grain refinement in the alloy. Preferably, Ti is controlled to be present in an amount in a range of 0.03 wt. % to 0.15 wt. % (0.03 wt. %≤Ti≤0.15 wt. %). More preferably, Ti is controlled to be present in an amount in a range of higher than 0.05 wt. % to 0.1 wt. % (0.05 wt. %≤Ti≤0.1 wt. %). When the content of Ti is lower than 0.03 wt. %, the effect of the addition of Ti is insignificant. On the other hand, when the content of Ti exceeds 0.15 wt. %, a large amount of large and coarse intermetallic compounds such as $TiAl_3$ are produced, which deteriorates the mechanical properties of the alloy. When the content of Ti is lower than 0.03 wt. %, the effect of the addition of Ti is insignificant. When the content of Ti exceeds 0.15 wt. %, the mechanical properties are deteriorated. Therefore, the Ti content lower than 0.03 wt. % or higher than 0.15 wt. % is not desirable.

In the alloy, Cr forms a compound with Al and is dispersed on grain boundaries, thereby inhibiting precipitation during aging and improving elongation. Preferably, Cr is controlled to be present in an amount in a range of 0.03 wt. % to 0.15 wt. % (0.03 wt. %≤Cr≤0.15 wt. %). More preferably, Cr is controlled to be present in an amount in a range of 0.05 wt. % to 0.1 wt. % (0.05 wt. %≤Cr≤0.1 wt. %). When the content of Cr is lower than 0.03 wt. %, the effect of the addition of Cr is insignificant. On the other hand, when the content of Cr exceeds 0.15 wt. %, the strength of the alloy is poor.

In the alloy, Zr improves corrosion resistance and enhances strength at high temperatures. Preferably, Zr is controlled to be present in an amount in a range of 0.03 wt. % to 0.15 wt. % (0.03 wt. %≤Zr≤0.15 wt. %). More preferably, Zr is controlled to be present in an amount in a range of 0.05 wt. % to 0.1 wt. % (0.05 wt. %≤Zr≤0.1 wt. %). When the content of Zr is lower than 0.03 wt. %, the effect of the addition of Zr is insignificant. When the content of Zr exceeds 0.15 wt. %, it is undesirable because cracks or breaks may occur.

In some embodiments of the present invention, 0.03 to 0.15 wt. % of Ti, 0.03 to 0.15 wt. % of Cr, and 0.03 to 0.15 wt. % of Zr may all be contained. In some embodiments of the present invention, 0.03 to 0.15 wt. % of Ti, 0.03 to 0.15 wt. % of Cr, and 0.03 to 0.15 wt. % of Zr may all be contained, in which Ti, Cr, and Zr may be contained in equal percentages by weight (wt. %). In some embodiments of the present invention, 0.05 to 0.1 wt. % of Ti, 0.05 0.1 wt. % of Cr, and 0.05 to 0.1 wt. % of Zr may all be contained.

As described above, the highly corrosion-resistant aluminum alloy according to the present invention may include: one or more components selected from among 0.1 wt. % or less (except for 0 wt. %) of Cu, 0.15 wt. % or less (except for 0 wt. %) of Si, 0.2 wt. % or less (except for 0 wt. %) of Fe, 0.9 to 1.5 wt. % of Mn, 0.03 to 0.15 wt. % of Ti, 0.03 to 0.15 wt. % of Cr, and 0.03 to 0.15 wt. % of Zr; and the remaining proportion of aluminum (Al) and unavoidable impurities.

More preferably, 0.05 to 0.1 wt. % of Ti, 0.05 to 0.1 wt. % of Cr, and 0.05 to 0.1 wt. % of Zr may all be contained, in which Ti, Cr, and Zr may be contained in equal percentages by weight (wt. %). Thus, corrosion resistance is improved while tensile strength and yield strength are good.

Hereinafter, the present invention will be described in more detail with reference to examples and experimental examples.

Preparation of Aluminum Alloy

Table 1 shows the compositions of highly corrosion-resistant aluminum alloys according to embodiments of the present invention, in which the content of each component is expressed in percentages by weight (wt. %). Aluminum alloy compositions (Examples 1 to 10) according to the present invention and aluminum alloy compositions compared the present invention (Comparative Examples 1 to 5) were prepared with the composition ratios shown in Table 1. Comparative Examples 4 and 5 used compositions of existing 3005 alloy and 3004 alloy. In Table 1, in each aluminum alloy, Al and unavoidable impurities account for the remaining proportion other than the added elements.

TABLE 1

| No. | Cu | Mg | Si | Fe | Mn | Zn | Ti | Cr | Zr | Al |
|---|---|---|---|---|---|---|---|---|---|---|
| Example 1 | 0.03 | 0 | 0.03 | 0.09 | 1.16 | 0 | 0.04 | 0.04 | 0.04 | 98.57 |
| Example 2 | 0.03 | 0 | 0.03 | 0.09 | 1.16 | 0 | 0.05 | 0.05 | 0.05 | 98.54 |
| Example 3 | 0.03 | 0 | 0.03 | 0.09 | 1.16 | 0 | 0.07 | 0.07 | 0.07 | 98.48 |
| Example 4 | 0.03 | 0 | 0.03 | 0.09 | 1.15 | 0 | 0.09 | 0.09 | 0.09 | 98.43 |
| Example 5 | 0.03 | 0 | 0.03 | 0.09 | 1.15 | 0 | 0.07 | 0.04 | 0.04 | 98.55 |
| Example 6 | 0.03 | 0 | 0.03 | 0.09 | 1.15 | 0 | 0.04 | 0.07 | 0.04 | 98.55 |
| Example 7 | 0.03 | 0 | 0.03 | 0.09 | 1.15 | 0 | 0.07 | 0.07 | 0.12 | 98.44 |
| Example 8 | 0.03 | 0 | 0.03 | 0.09 | 1.15 | 0 | 0.07 | 0.12 | 0.07 | 98.44 |
| Example 9 | 0.03 | 0 | 0.03 | 0.09 | 1.15 | 0 | 0.12 | 0.07 | 0.07 | 98.44 |
| Example 10 | 0.03 | 0 | 0.03 | 0.09 | 1.15 | 0 | 0.12 | 0.12 | 0.12 | 98.34 |
| Comparative Example 1 | 0.03 | 0 | 0.03 | 0.09 | 1.16 | 0 | 0.02 | 0.02 | 0.02 | 98.63 |
| Comparative Example 2 | 0.03 | 0 | 0.03 | 0.09 | 1.16 | 0 | 0.18 | 0.18 | 0.18 | 98.15 |
| Comparative Example 3 | 0.03 | 0 | 0.03 | 0.09 | 1.15 | 0 | 0.21 | 0.21 | 0.21 | 98.07 |
| Comparative Example 4 | 0.3 | 0.2 | 0.6 | 0.7 | 0.8 | 0.25 | 0.1 | 0.2 | 0 | 96.85 |
| Comparative Example 5 | 0.25 | 0.8 | 0.3 | 0.7 | 1 | 0.25 | 0 | 0 | 0 | 96.7 |

Specimen Fabrication and Mechanical Evaluation

With the use of the three alloys of Examples 2 to 4 according to the present invention, test specimens in accordance with the ASTM standard were prepared, and the yield strength and tensile strength of each test specimen were measured with a tensile tester at room temperature. As a result, as shown in Table 2, the alloys of Examples 2 to 4 of the present invention all exhibited a tensile strength of 180 $N/mm^2$ or higher. The alloys other than the alloys of Examples 2, 3, and 4 also exhibited a tensile strength of 180 $N/mm^2$ or higher. It has been found that the tensile strength of each of the comparative examples, measured under identical conditions, was lower than 180 $N/mm^2$.

TABLE 2

| No. | Tensile strength ($N/mm^2$) | Yield strength ($N/mm^2$) |
|---|---|---|
| Example 2 | 191 | 79 |
| Example 3 | 185 | 70 |
| Example 4 | 187 | 77 |

Receiver Dryer Fabrication and Mechanical Evaluation

Aluminum billets were prepared with the aluminum alloy compositions according to Examples 1 to 10 of the present invention and the aluminum alloy compositions according to Comparative Examples 1 and 5. The billets were extruded and drawn to produce aluminum pipes. The respective ends of each aluminum pipe were shaped and bent to form the shape of a receiver dryer.

Figure 2:
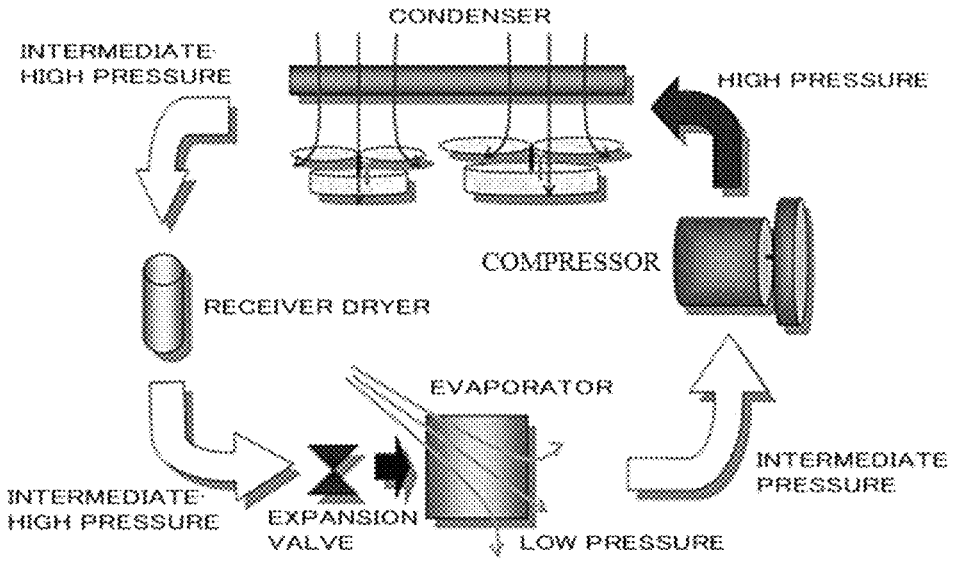
FIG. 2 is a schematic diagram of an automotive air conditioner (heat exchanger) and a receiver dryer.
Figure 3A:
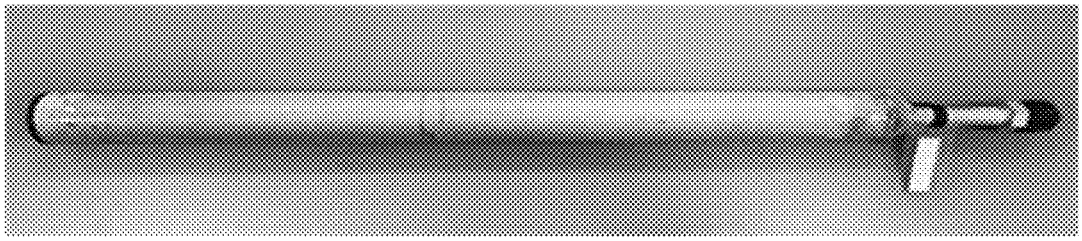
FIGS. 3*a* and 3*b* are photographs taken before and after corrosion resistance evaluation of a receiver dryer made of an aluminum alloy composition according to an example of the present invention.
Figure 3B:
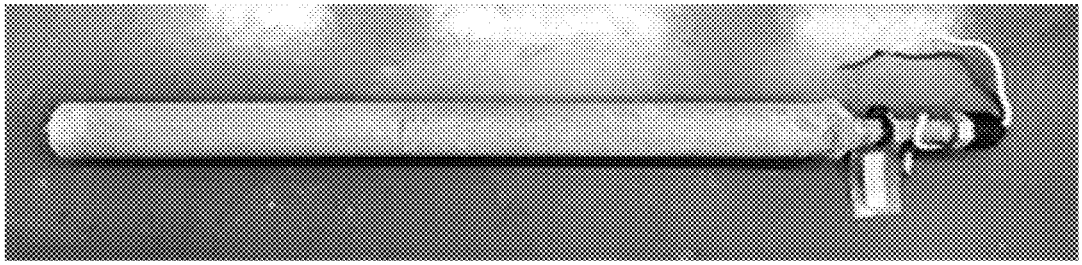
Figure 4A:
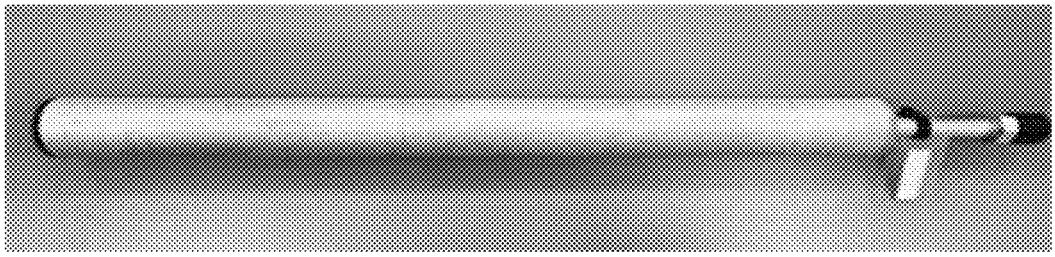
FIGS. 4*a* and 4*b* are photographs taken before and after corrosion resistance evaluation of a receiver dryer made of an aluminum alloy composition according to a comparative example of the present invention.
Figure 4B:
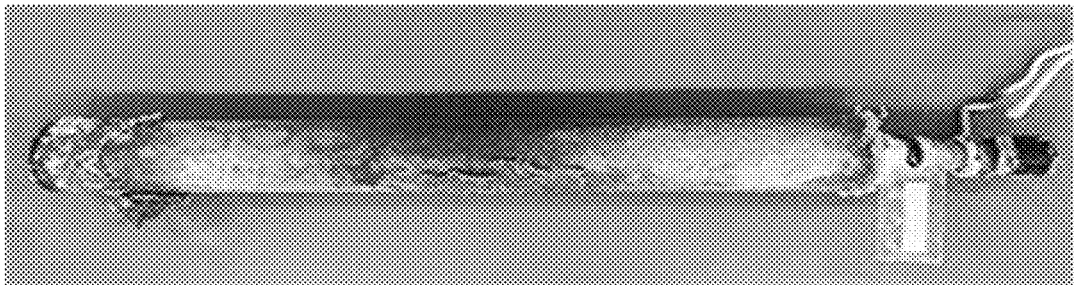

Receiver dryers with a thickness of 1.6 T and receiver dryers with a thickness of 1.8 T were manufactured, and the corrosion resistance thereof was evaluated. FIG. 2 is a photograph taken before and after corrosion resistance evaluation of a receiver dryer manufactured from an aluminum alloy composition according to one embodiment of the present invention, and FIGS. 4A and 4B are photographs taken before and after corrosion resistance evaluation of a receiver dryer manufactured from an aluminum alloy composition according to a comparative example of the present invention. As illustrated in FIG. 4(*b*), leak can be identified after the corrosion resistance evaluation.

Table 3 shows the results of a corrosion resistance test of each of the receiver dryers made from the respective aluminum alloy compositions shown in Table 1. In the corrosion resistance test (SWAAT-seawater acidified test), the corrosion resistance was evaluated by spraying saline into the specimens according to the regulations to promote corrosion. A nitrogen pressure of 1.6±0.04 MPa (16.7 $kgf/cm^2$) was applied to the inside of a condenser. The salt concentration of synthesized seawater was 42 g/1 L, the spray volume was in a range of 1 to 2 ml/h, the specific gravity was in a range of 1.0255 to 1.0400, the pH was in a range of 2.8 to 3.0 (in compliance with ASTM G85 94-A3), and the test time was 500 to 2000 hours.

Distilled water was added to a tank, and the synthetic sea salt was added to the distilled water, in an amount according to the amount of the distilled water and stirred until being completely dissolved. Acetic acid was added in an amount that varies depending on the amount of the distilled water and stirred. Next, a PM meter was used to check whether the test solution satisfies the preset conditions. After 1 hour of a test operation, it was checked whether the spray volume meets the conditions, and then the specimens were put into a chamber. The temperature of the chamber was set at 49° C., and the specimens were tested under conditions of 30 min spray and 90 min leave for 250 cycles (500 hr), 500 cycles (1,000 hr), and 1000 cycles (2,000 hr).

TABLE 3

| No. | Product Thickness | Test result: After 250 cycles and 500 hours of testing Leak/No leak | After 500 cycles and 1,000 hours of testing Leak/No leak | After 1000 cycles and 2,000 hours of testing Leak/No leak |
|---|---|---|---|---|
| Example 1 | | No leak | No leak | Leak |
| Example 2 | | No leak | No leak | No leak |
| Example 3 | | No leak | No leak | No leak |
| Example 4 | | No leak | No leak | No leak |
| Example 5 | | No leak | No leak | Leak |
| Example 6 | | No leak | No leak | Leak |
| Example 7 | | No leak | No leak | Leak |
| Example 8 | 1.6T | No leak | No leak | Leak |
| Example 9 | | No leak | No leak | Leak |
| Example 10 | | No leak | No leak | Leak |
| Comparative Example 1 | | No leak | Leak | Leak |
| Comparative Example 2 | | No leak | Leak | Leak |
| Comparative Example 3 | | No leak | Leak | Leak |
| Comparative Example 4 | | No leak | Leak | Leak |
| Comparative Example 5 | | No leak | Leak | Leak |
| Example 1 | | No leak | No leak | No leak |
| Example 2 | | No leak | No leak | No leak |
| Example 3 | | No leak | No leak | No leak |
| Example 4 | | No leak | No leak | No leak |
| Example 5 | | No leak | No leak | No leak |
| Example 6 | | No leak | No leak | No leak |
| Example 7 | | No leak | No leak | No leak |
| Example 8 | 1.8T | No leak | No leak | No leak |
| Example 9 | | No leak | No leak | No leak |
| Example 10 | | No leak | No leak | No leak |
| Comparative Example 1 | | No leak | No leak | Leak |
| Comparative Example 2 | | No leak | No leak | Leak |
| Comparative Example 3 | | No leak | No leak | Leak |
| Comparative Example 4 | | No leak | Leak | Leak |
| Comparative Example 5 | | No leak | Leak | Leak |

As shown in Table 3, in the corrosion resistance evaluation, in terms of leakage, Examples and Comparative Examples exhibited good results (i.e., no leak) after 250 cycles and 5000 hours of testing. After 250 cycles and 5000 hours of testing, Comparative Examples 1 to 5 exhibited leaks while Examples 1 to 10 exhibited no leaks. In the case of the receiver dryers with a thickness of 1.6 T, Comparative Examples 1 to 5 exhibited leaks. Therefore, in the case of the receiver dryers made from the aluminum alloys of Examples 1 to 10 according to the present invention, no leaks occurred under conditions of 500 cycles and 1000 hours of testing, saline water environment, 1.6 T thickness, and 1.8 T thickness. Therefore, it was confirmed that the aluminum alloys of Examples 1 to 10 had sufficient corrosion resistance required for the receiver dryer materials.

In addition, the corrosion resistance evaluation was also performed in a harsh environment of 1000 cycles and 2,000 hours. The test results show that in the case of the alloys of Examples 2 to 4, no leaks occurred even in the harsh environment of 1000 cycles and 2,000 hours, regardless of the thicknesses, 1.6 T and 1.8 T. It is confirmed that the alloys of Examples 2 to 4 containing Ti, Cr, and Zr in equal weight percentages within a range of 0.05 to 0.1 wt. % has excellent corrosion resistance.

As such, according to the present invention, it is possible to provide a highly corrosion-resistant aluminum alloy that is corrosion resistant even in a saline environment while being excellent in tensile strength and yield strength. The highly corrosion-resistant aluminum alloy according to the present invention can be applied to all kinds of aluminum parts aside from receiver dryers. In the case, and the same effect can be obtained. Therefore, the highly corrosion-resistant aluminum alloy can be used to manufacture not only vehicle receiver dryers but also pipe structures, through extrusion and drawing, the pipe structure being used as a refrigerant line of a vehicle refrigerant delivery system, a coolant line, and a transmission oil cooler line.

In addition, the highly corrosion-resistant aluminum alloy according to the present invention can be used in various applications such as refrigerators, washing machines, domestic air conditioners, heat sinks of electronic devices such as LEDs, electrical goods, roofing materials, chemical apparatuses, kitchen utensils, and ship exterior materials.

Although the preferred examples of the present invention have been disclosed for illustrative purposes, those skilled in the art will appreciate that various modifications, additions and substitutions are possible, without departing from the technical idea of the invention.

EXPLANATION OF REFERENCE NUMERALS IN THE DRAWINGS

10: Receiver dryer
20: Condenser
30: Pipe
40: Hose
50: Compressor
60: Hose
70: Expansion valve
80: Evaporator

The invention claimed is:

1. An aluminum alloy consisting of: 0.1 wt. % or less (except for 0 wt. %) of Cu, 0.15 wt. % or less (except for 0 wt. %) of Si, 0.2 wt. % or less (except for 0 wt. %) of Fe, 0.9 to 1.5 wt. % of Mn, 0.03 to 0.15 wt. % of Ti, 0.03 to 0.15 wt. % of Cr, and 0.03 to 0.15 wt. % of Zr; and the remaining proportion of aluminum (Al) and unavoidable impurities.

2. The aluminum alloy of claim 1, wherein the Ti, Cr and Zr are comprised in equal weight percentages.

3. The aluminum alloy of claim 1, comprising all of the 0.05 to 0.1 wt. % of Ti, the 0.05 to 0.1 wt. % of Cr, and the 0.05 to 0.1 wt. % of Zr.

4. The aluminum alloy of claim 3, wherein the Ti, Cr and Zr are comprised in equal weight percentages.

* * * * *